US010347205B2

(12) United States Patent
Chang et al.

(10) Patent No.: US 10,347,205 B2
(45) **Date of Patent: *Jul. 9, 2019**

(54) DATA CONVERSION METHOD AND DISPLAY DEVICE USING THE SAME

(71) Applicant: Sitronix Technology Corp., Hsinchu County (TW)

(72) Inventors: Chih-Wei Chang, Hsinchu County (TW); Wen-Yuan Kuo, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/163,512

(22) Filed: Oct. 17, 2018

(65) Prior Publication Data

US 2019/0051260 A1 Feb. 14, 2019

Related U.S. Application Data

(63) Continuation of application No. 15/052,898, filed on Feb. 25, 2016, now Pat. No. 10,140,939.

(30) Foreign Application Priority Data

Dec. 22, 2015 (TW) ..... 104143061 A

(51) Int. Cl.
*G09G 3/36* (2006.01)

(52) U.S. Cl.
CPC ... *G09G 3/3648* (2013.01); *G09G 2320/0252* (2013.01); *G09G 2320/0285* (2013.01); *G09G 2320/041* (2013.01); *G09G 2340/16* (2013.01)

(58) Field of Classification Search
CPC ..... G09G 3/3648; G09G 2320/041; G09G 2320/0285; G09G 2320/0252
See application file for complete search history.

(56) References Cited

U.S. PATENT DOCUMENTS

| | | | | |
|---|---|---|---|---|
| 2005/0068343 | A1 | 3/2005 | Pan | |
| 2005/0179854 | A1 | 8/2005 | Sekine | |
| 2006/0012554 | A1 | 1/2006 | Saishu | |
| 2006/0197740 | A1 * | 9/2006 | Xu | G06F 1/206 345/156 |
| 2008/0136767 | A1 | 6/2008 | Kim | |
| 2008/0191995 | A1 * | 8/2008 | Cheon | G09G 3/20 345/101 |

(Continued)

FOREIGN PATENT DOCUMENTS

| | | | |
|---|---|---|---|
| CN | 101010719 | A | 8/2007 |
| CN | 101202021 | A | 6/2008 |

(Continued)

*Primary Examiner* — Abbas I Abdulselam
(74) *Attorney, Agent, or Firm* — Winston Hsu

(57) ABSTRACT

A data conversion method for converting display data of a display device includes detecting an ambient temperature of the display device; receiving a specific display data to be displayed by the display device, a previous display data in N row before the specific display data, and a next display data in N row after the specific display data; converting the specific display data into a display output data according to the previous display data, the next display data and the ambient temperature; and outputting the display output data to perform displaying.

9 Claims, 8 Drawing Sheets

(56) References Cited

U.S. PATENT DOCUMENTS

| | | | | |
|---|---|---|---|---|
| 2013/0120233 | A1 | 5/2013 | Jeon | |
| 2013/0328799 | A1* | 12/2013 | Bi | G06F 3/041 345/173 |
| 2016/0358570 | A1* | 12/2016 | Wang | G09G 3/3677 |
| 2017/0178585 | A1* | 6/2017 | Chang | G09G 3/3648 |

FOREIGN PATENT DOCUMENTS

| | | | |
|---|---|---|---|
| CN | 101266764 | A | 9/2008 |
| CN | 103400559 | A | 11/2013 |
| TW | 201546781 | | 12/2015 |

* cited by examiner

DATA CONVERSION METHOD AND DISPLAY DEVICE USING THE SAME

CROSS REFERENCE TO RELATED APPLICATIONS

This application is a continuation application of U.S. application Ser. No. 15/052,898, filed on Feb. 25, 2016, the contents of which are incorporated herein by reference.

BACKGROUND OF THE INVENTION

1. Field of the Invention

The present invention relates to a data conversion method and a display device, and more particularly, to a data conversion method and a related display device capable of converting display data by using data processing.

2. Description of the Prior Art

Liquid crystal display (LCD) is the highest developed and the most popular display device among various flat panel displays in the market. The LCD may be divided into three types, which are the static matrix, simple matrix and active matrix, according to the driving method. The simple matrix LCD is the so-called passive LCD, which can further be divided into the twisted nematic LCD (TN-LCD) and the super twisted nematic LCD (STN-LCD). The active matrix LCD is represented by the thin film transistor LCD (TFT-LCD), which is the mainstream of LCD currently.

In general, the panel of the TFT-LCD includes a layer of liquid crystals placed between two layers of glass substrates, where the upper glass substrate layer has a color filter and the lower glass substrate layer includes embedded transistors. Light can be outputted from a backlight source. When a current flowing through the transistors generates variations on electric fields, liquid crystal molecules may be twisted to change light polarities. A polarizer film is utilized to determine the brightness of pixels. In addition, the upper glass substrate layer is glued to the color filter, so that each pixel includes three primary colors, i.e., red, blue and green. These pixels radiating three primary colors construct the image on the panel.

The above transistors located in the LCD panel may be controlled by a driving circuit. In general, the driving circuit may output the data to be displayed to the transistors in the panel, so that each pixel may accurately display the predetermined brightness or gray scale. However, under a low temperature such as 0° C. or lower, the voltage changing speed of a transistor may slow down, such that the transistor cannot achieve its target voltage level. Therefore, the pixel corresponding to the transistor may not display the predetermined brightness or gray scale. In such a condition, the image displayed on the panel in low temperature may appear to be a blur. Thus, there is a need for improvement over the prior art.

SUMMARY OF THE INVENTION

It is therefore an objective of the present invention to provide a data conversion method and a related display device, which are capable of converting display data by using data processing. According to the data conversion method of the present invention, the display data may be effectively controlled in low temperature, so that the image displayed on the panel may have contrast and clarity to certain level, in order to prevent the image from being a blur.

The present invention discloses a data conversion method for converting display data of a display device. The data conversion method comprises detecting an ambient temperature of the display device; receiving a specific display data to be displayed by the display device, a previous display data in N row before the specific display data, and a next display data in N row after the specific display data; converting the specific display data into a display output data according to the previous display data, the next display data and the ambient temperature; and outputting the display output data to perform displaying.

The present invention further discloses a display device for performing a data conversion method. The display device comprises a temperature detector, a storage device, a line buffer and a processor. The temperature detector is used for detecting an ambient temperature of the display device. The storage device is used for storing a plurality of lookup tables. The line buffer is used for receiving and storing a specific display data to be displayed by the display device and a previous display data in N row before the specific display data. The processor is used for receiving a next display data in N row after the specific display data and performing the following steps: obtaining a lookup table corresponding to the ambient temperature from the plurality of lookup tables; obtaining a display output data from the lookup table according to a first data change amount between the previous display data and the specific display data and a second data change amount between the specific display data and the next display data; and outputting the display output data to perform displaying.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
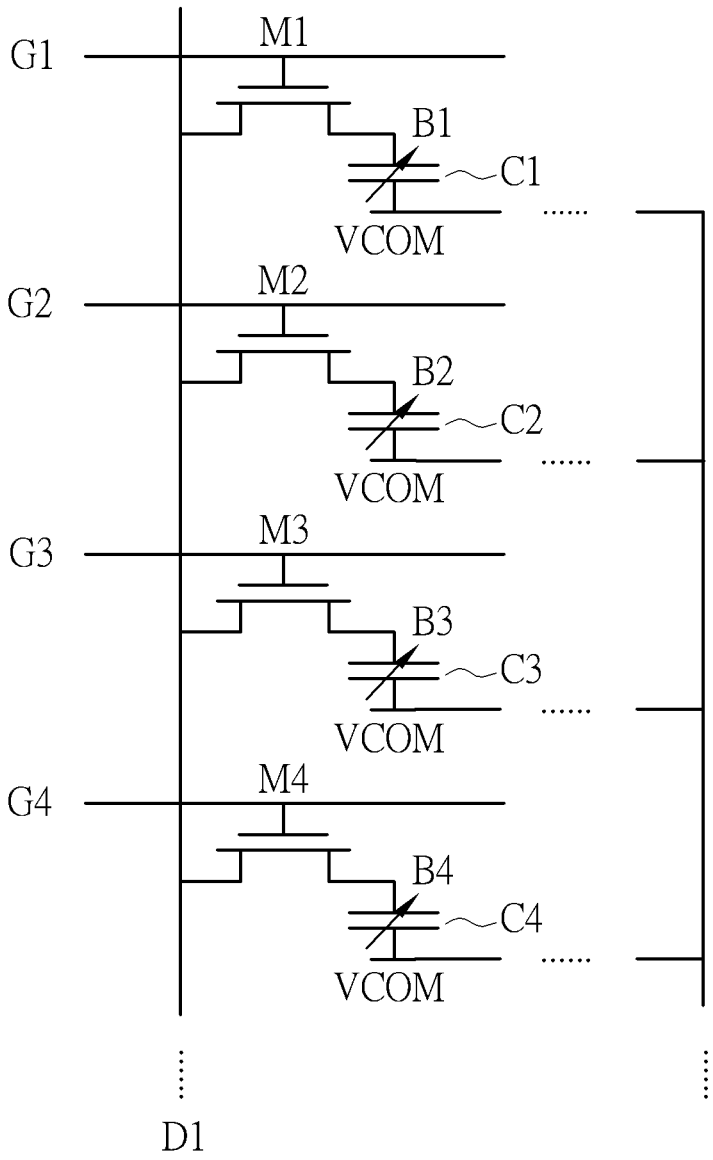
FIG. 1A is a schematic diagram of the circuit structure of a display panel of a display device.
Figure 1B:
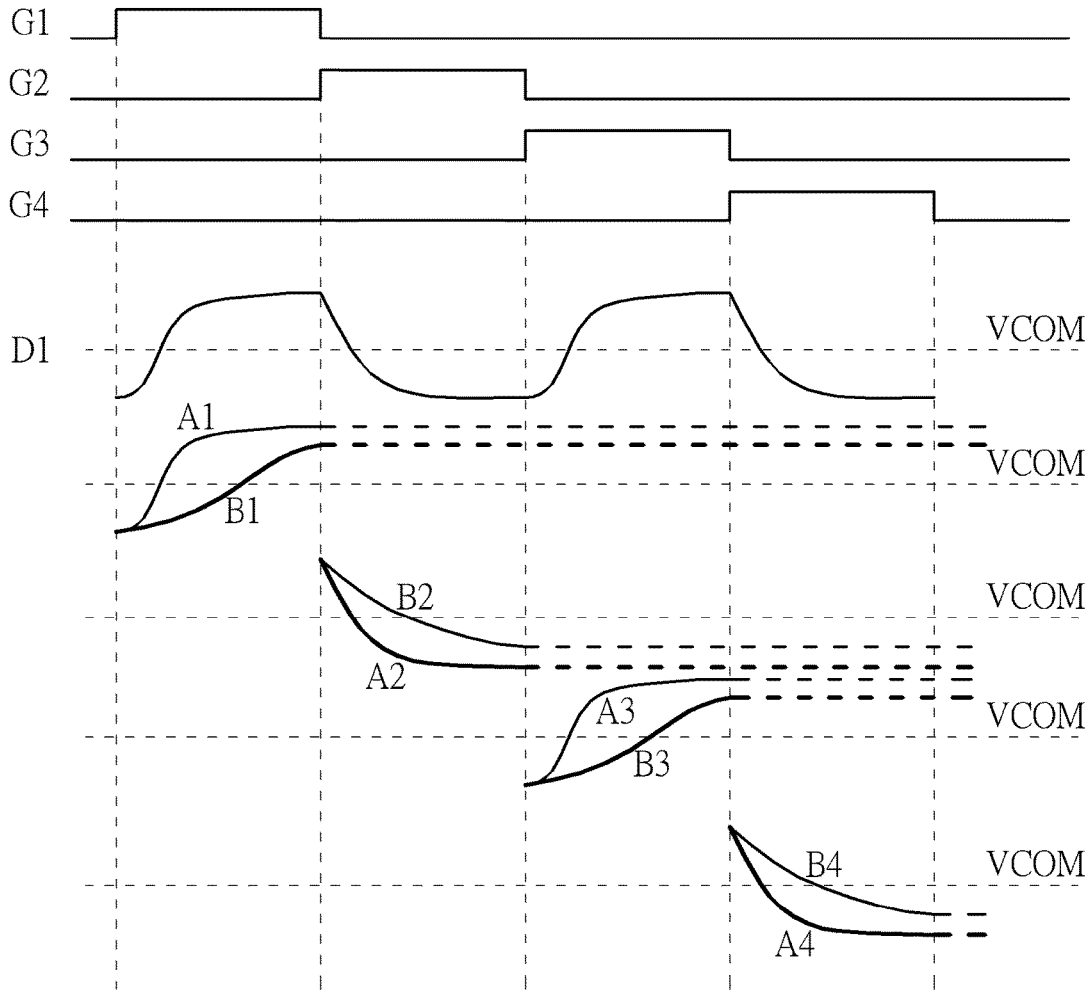
FIG. 1B is a waveform diagram of the display panel operated in low temperature.

Please refer to FIG. 1A and FIG. 1B. FIG. 1A is a schematic diagram of the circuit structure of a display panel 10 of a display device. FIG. 1B is a waveform diagram of the display panel 10 operated in low temperature. As shown in FIG. 1A, the display panel 10 includes transistors M1-M4 and corresponding capacitors C1-C4. The transistors M1-M4 are only used for denoting 4 transistors arranged in a column on the display panel 10. In fact, the display panel 10 may include any number of transistors, which may be arranged as a matrix with any columns and any rows. Each transistor is connected to a corresponding capacitor used for storing display data. As shown in FIG. 1B, the transistors M1-M4, respectively receiving gate driving signals G1-G4, are turned on in turn, and display data D1 may be inputted in a line. However, in low temperature, source voltages B1-B4 change more slowly and may not achieve the predetermined voltages, such that the corresponding pixels cannot display the predetermined brightness or gray scale.

Figure 1C:
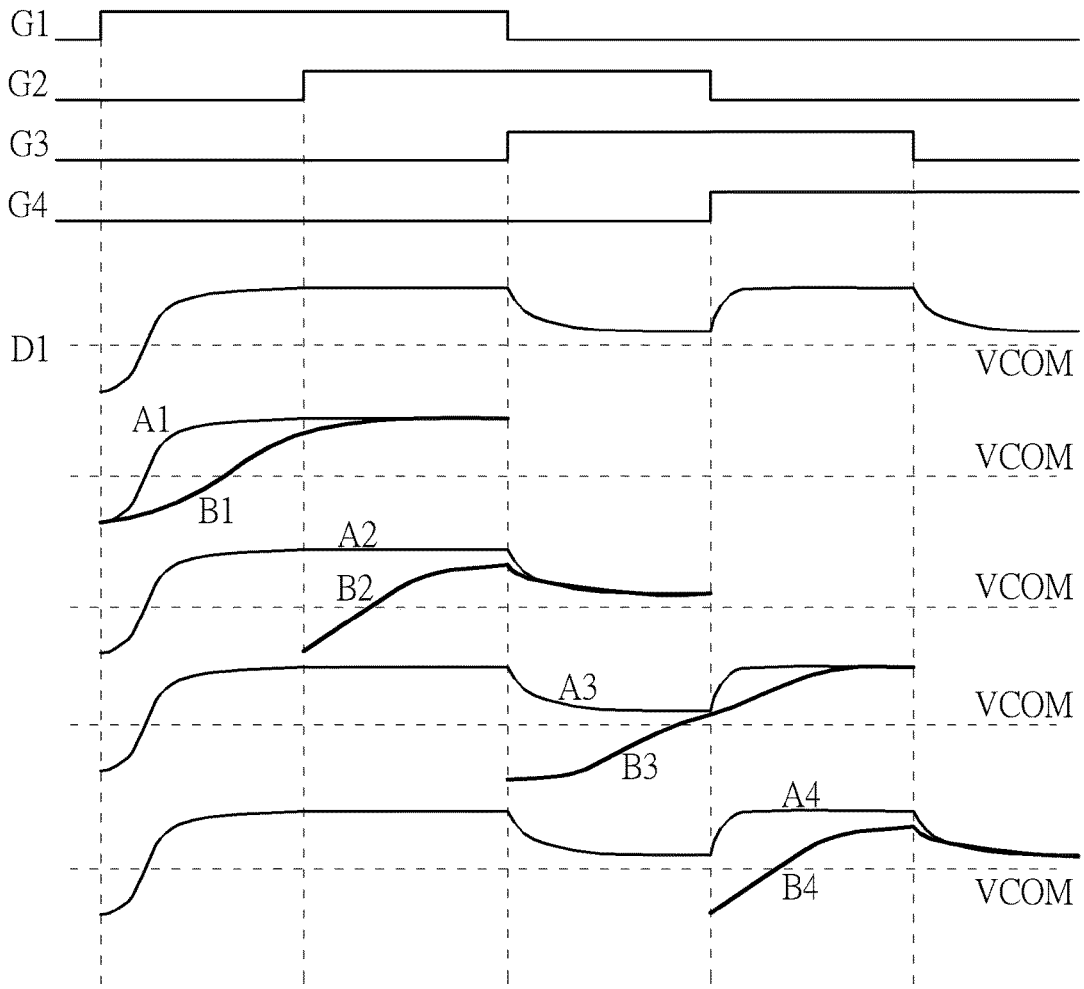
FIG. 1C is a waveform diagram of the display panel applying column inversion and pre-charging and operated in low temperature.

Please refer to FIG. 1C, which is a waveform diagram of the display panel 10 applying column inversion and pre-charging and operated in low temperature. In FIG. 1C, the display data D1 is outputted with column inversion, e.g., the display data D1 in the same column have positive polarities (i.e., having voltages greater than the common voltage VCOM), and the display data in the previous column and the next column have negative polarities (i.e., having voltages smaller than the common voltage VCOM). Different from the image in FIG. 1B which applies dot inversion (i.e., display data corresponding to two adjacent pixels have inverse polarities), the column inversion may be operated with pre-charging, so that the source voltages B1-B4 on the capacitors C1-C4 may have enough time to perform charging, in order to successfully achieve the predetermined voltages. In detail, when the display device displays the previous image, the source voltages B1-B4 smaller than the common voltage VCOM may undergo pre-charging in the previous data output cycle, so that the source voltages B1-B4 may return to a voltage level greater than the common voltage VCOM in advance. Subsequently, the source voltages B1-B4 may easily achieve the predetermined voltages in the corresponding data output cycle. In this manner, the problem where the source voltages B1-B4 cannot achieve the predetermined voltages in low temperature may be prevented.

However, when the temperature is extremely low and/or when the difference of display data is extremely large, the source voltages B1-B4 still may not achieve the predetermined voltage to output the predetermined display data. In such a condition, the image displayed on the panel may appear to be a blur. Therefore, the data conversion method of the present invention may determine whether to perform adjustment or conversion on the display data in low temperature according to whether the change amount of display data exceeds a data change threshold corresponding to the ambient temperature.

Figure 2:
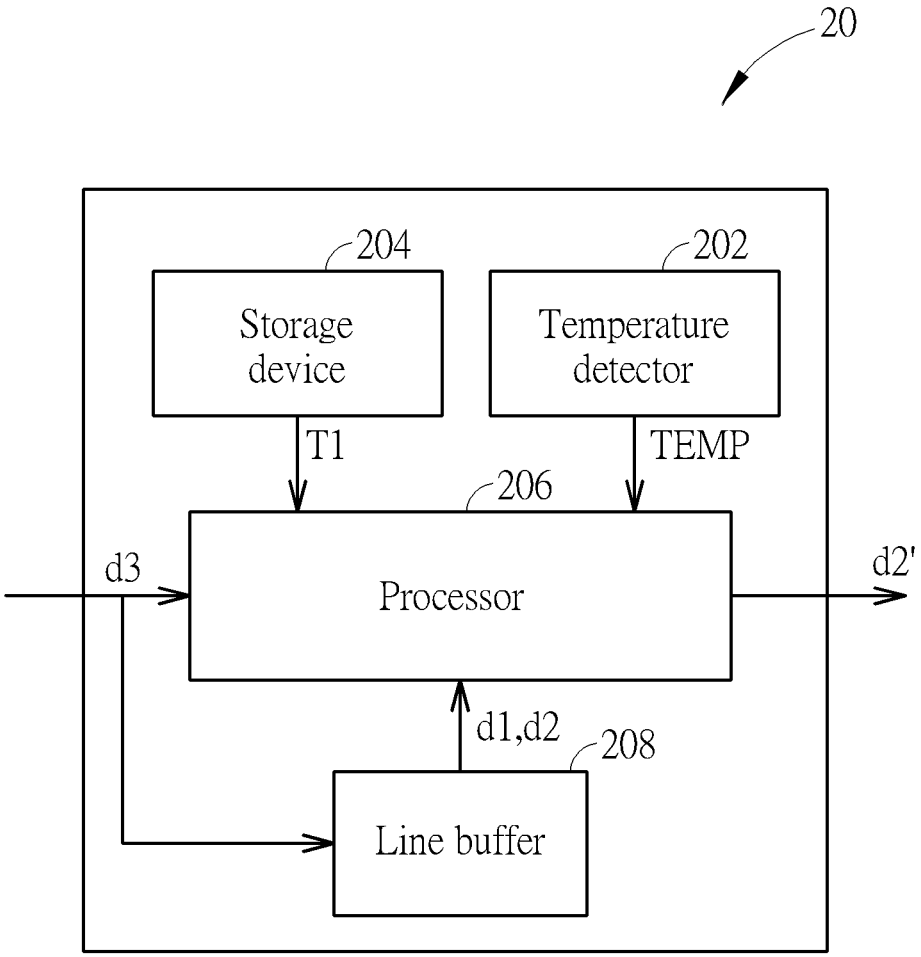
FIG. 2 is a schematic diagram of a display device according to an embodiment of the present invention.

Please refer to FIG. 2, which is a schematic diagram of a display device 20 according to an embodiment of the present invention. As shown in FIG. 2, the display device 20 includes a temperature detector 202, a storage device 204, a processor 206 and a line buffer 208. The temperature detector 202 is used for detecting an ambient temperature TEMP of the display device 20. The storage device 204 is used for storing a plurality of lookup tables, wherein each lookup table corresponds to a specific ambient temperature TEMP. For example, 0° C. to −5° C. may correspond to a lookup table, and −5° C. to −10° C. may correspond to another lookup table, and so on. The line buffer 208 is used for receiving and storing a specific display data d2 to be displayed by the display device 20 and a previous display data d1 in N row before the specific display data d2. The processor 206 is used for receiving a next display data d3 in N row after the specific display data d2. For example, when N is equal to 1, the previous display data d1 is display data of a pixel in the previous row adjacent to the pixel corresponding to the specific display data d2, and the next display data d3 is display data of a pixel in the next row adjacent to the pixel corresponding to the specific display data d2.

Subsequently, the processor 206 may convert the specific display data d2 into a display output data d2' according to the previous display data d1, the next display data d3 and the ambient temperature TEMP. In detail, the processor 206 may obtain a lookup table T1 corresponding to the current ambient temperature TEMP from the plurality of lookup tables. The processor 206 then obtains the display output data d2' from the lookup table T1 according to a first data change amount between the previous display data d1 and the specific display data d2 and a second data change amount between the specific display data d2 and the next display data d3, and also according to magnitudes of the previous display data d1, the specific display data d2 and the next display data d3. Therefore, the processor 206 may output the display output data d2' and display the display output data d2' on the panel.

The data conversion method of the present invention includes many conversion methods defined in the lookup tables. The detailed conversion methods are determined according to whether the change amounts between the previous display data d1, the specific display data d2 and the next display data d3 exceed the data change threshold corresponding to the specific ambient temperature. The above data change threshold may be defined as the maximum possible change amount of the display data in the specific ambient temperature. When the difference between a display data and its previous display data does not exceed the data change threshold, the display data may be displayed normally; that is, the voltage stored in the capacitor corresponding to the pixel is able to achieve the voltage of the display data. In contrast, when the difference between a display data and its previous display data is greater than the data change threshold, the display data may not be displayed normally; that is, the corresponding pixel may not display the predetermined brightness or gray scale.

Figure 3A:
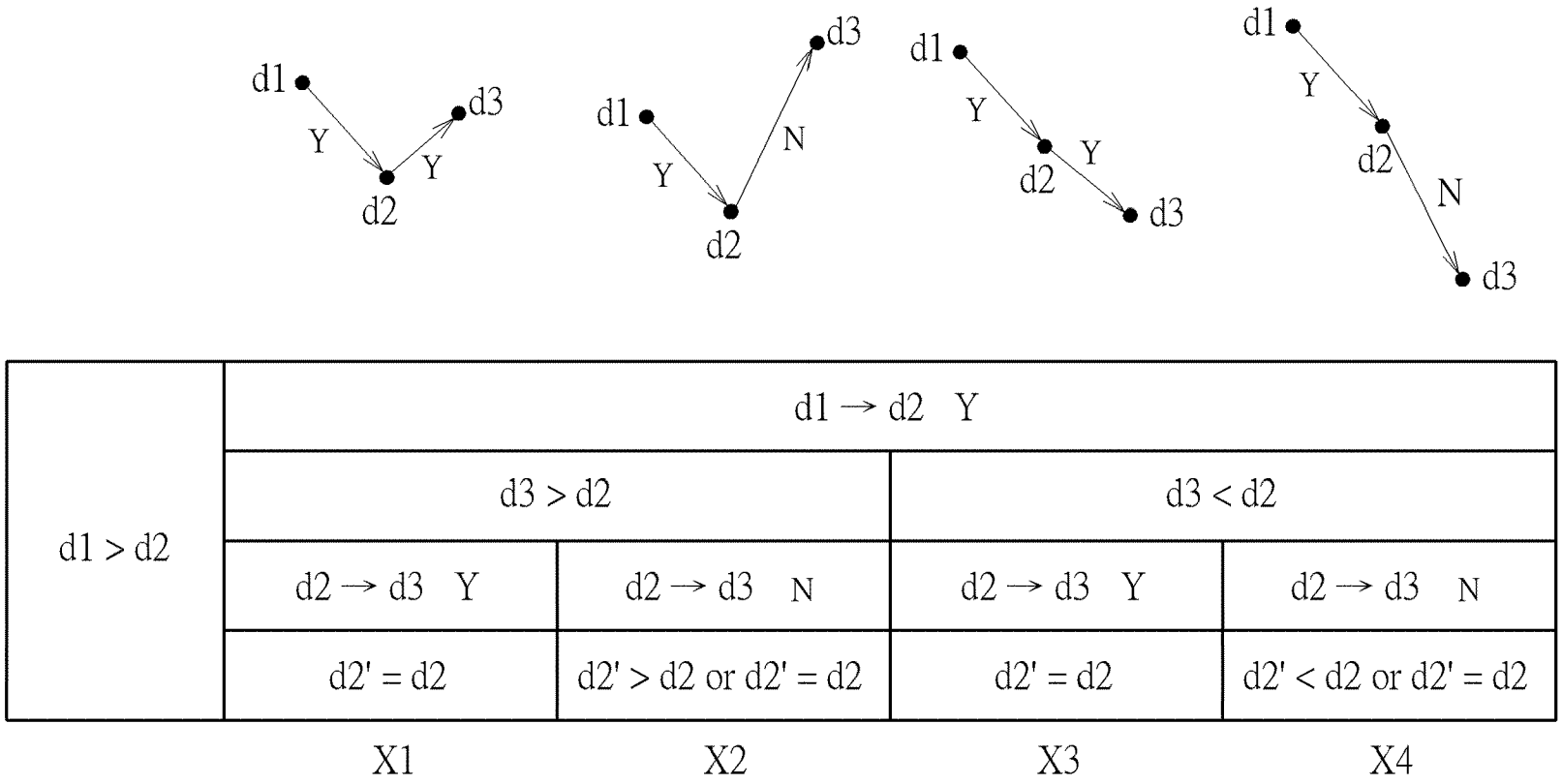
FIGS. 3A-3C are schematic diagrams of implementations of the data conversion method according to an embodiment of the present invention.
Figure 3B:
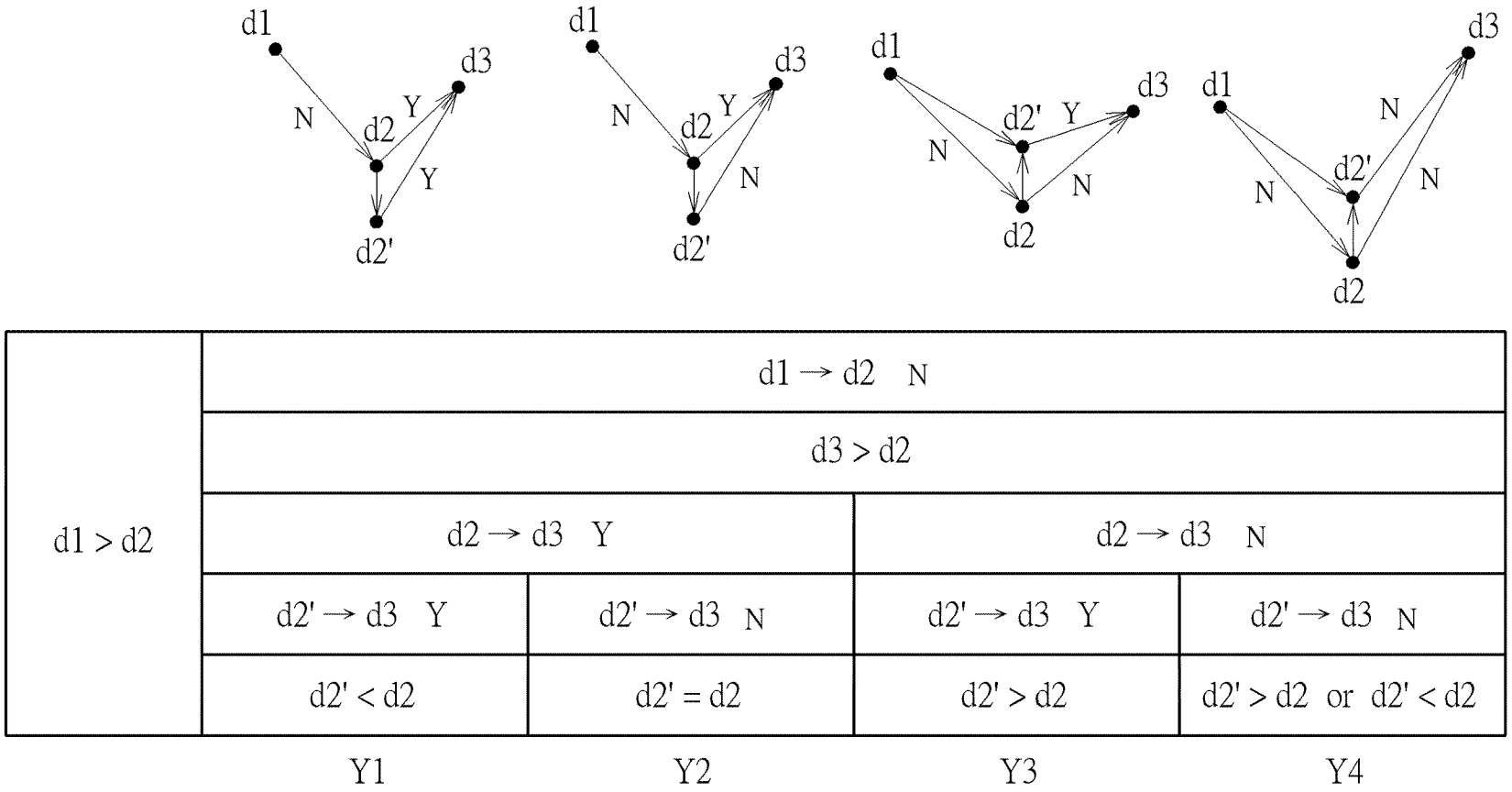
Figure 3C:
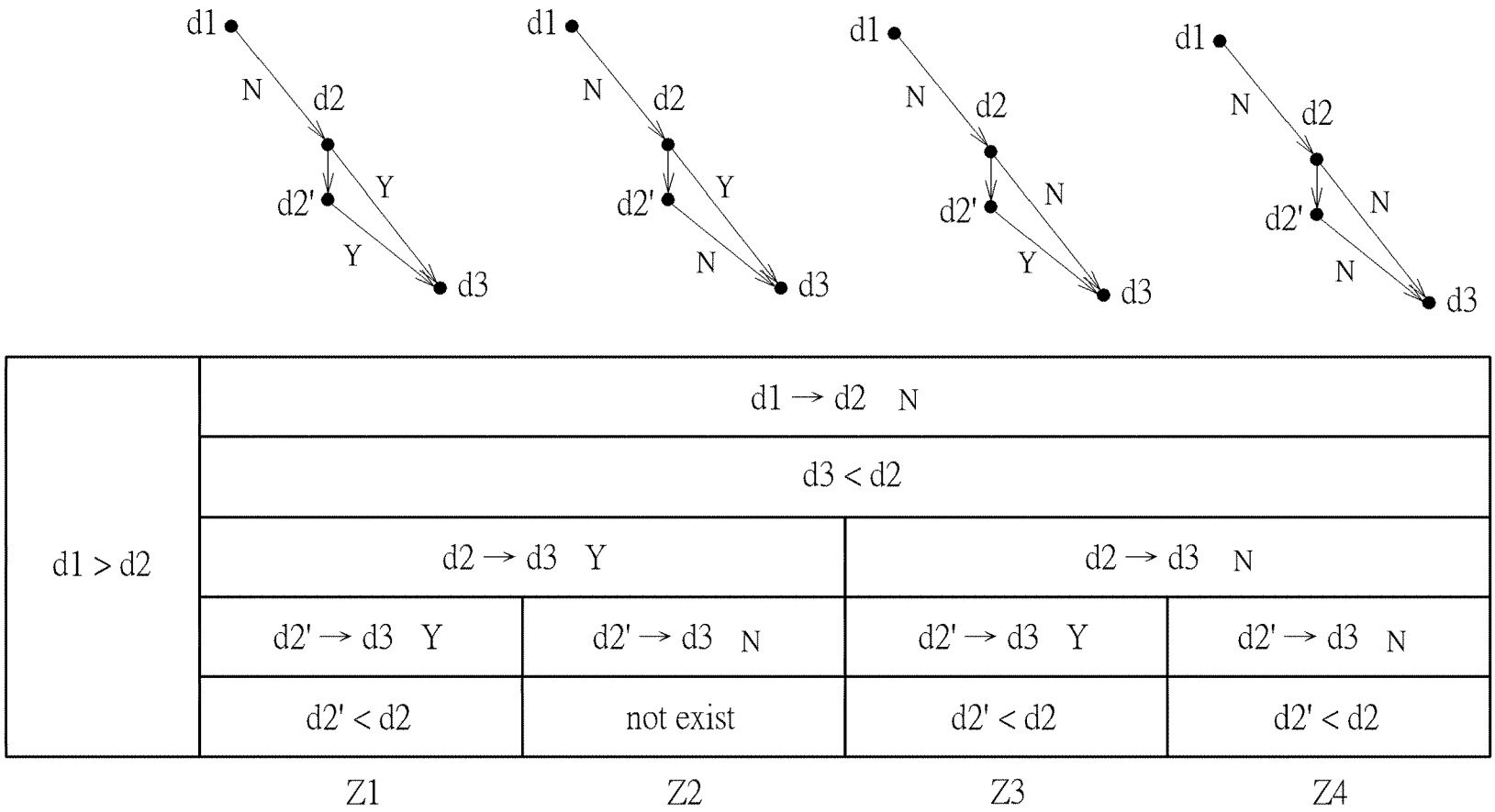

Please refer to FIGS. 3A-3C, which are schematic diagrams of implementations of the data conversion method according to an embodiment of the present invention. FIGS. 3A-3C illustrate the situations of whether the change amounts between the previous display data d1, the specific display data d2 and the next display data d3 exceed the data change threshold and the corresponding data conversion methods respectively. FIG. 3A illustrates the situation where the first data change amount between the previous display data d1 and the specific display data d2 is smaller than the data change threshold. FIG. 3B and FIG. 3C illustrate the situations where the first data change amount between the previous display data d1 and the specific display data d2 is greater than the data change threshold. In FIGS. 3A-3C, if the change amount between two adjacent display data is smaller than the data change threshold, the voltage stored in the capacitor may achieve the voltage of display data, which is denoted by "Y", e.g., d1→d2 Y, d2→d3 Y. If the change amount between two adjacent display data is greater than the data change threshold, the voltage stored in the capacitor may not achieve the voltage of display data, which is denoted by "N", e.g., d1→d2 N, d2→d3 N.

FIG. 3A illustrates four embodiments X1-X4, where the previous display data d1 is greater than the specific display data d2, and the first data change amount between the previous display data d1 and the specific display data d2 is smaller than the data change threshold corresponding to the ambient temperature TEMP. In such a situation, the specific display data d2 may be displayed normally in the ambient temperature TEMP. The embodiments X1 and X2 illustrate the situation where the specific display data d2 is smaller than the next display data d3, and the embodiments X3 and X4 illustrate the situation where the specific display data d2 is greater than the next display data d3. The embodiments X1 and X3 illustrate the situation where the second data change amount between the specific display data d2 and the next display data d3 is smaller than the data change threshold. In other words, in the embodiments X1 and X3, both of the first data change amount and the second data change amount are smaller than the data change threshold corresponding to the ambient temperature TEMP. In such a situation, both of the specific display data d2 and the next display data d3 can be displayed normally. At this moment, the display output data d2' may be the same as the specific display data d2. That is, the processor 206 may directly output the specific display data d2 to display the specific display data d2 without performing conversion on the specific display data d2, or the processor 206 may obtain the display output data d2' having the same value as the specific display data d2 according to the lookup table T1.

On the other hand, the embodiments X2 and X4 illustrate the situation where the second data change amount between the specific display data d2 and the next display data d3 is greater than the data change threshold. In other words, in the embodiments X2 and X4, the first data change amount is smaller than the data change threshold corresponding to the ambient temperature TEMP, and the second data change amount is greater than the data change threshold. In such a situation, the specific display data d2 can be displayed normally but the next display data d3 cannot be displayed normally. At this moment, the display output data d2' may be the same as the specific display data d2, or the display output data d2' in comparison with the specific display data d2 is nearer to the next display data d3. The former means that the original specific display data d2 remains, so that the specific display data d2 may be displayed normally. The latter means that the accuracy of displaying the specific display data d2 is sacrificed to allow the next display data d3 to be displayed normally. Please note that, if low temperature causes several change amounts of the display data exceed the data change threshold corresponding to the ambient temperature TEMP, the data conversion method of the present invention is capable of achieving the accuracies of most data, so that most data can be displayed normally or have small errors. This allows the image displayed on the panel to have contrast and clarity to certain level, and the image is prevented from being a blur. In the above embodiments X2 and X4, although the accuracies of the specific display data d2 and the next display data d3 displayed on the panel cannot be satisfied simultaneously, the accuracy of the specific display data d2 may be satisfied by maintaining the original specific display data d2 or the accuracy of the next display data d3 may be satisfied by adjusting the display output data d2' to let the display output data d2' to be nearer to the next display data d3 (e.g., the display output data d2' is controlled to be greater than the specific display data d2 in the embodiment X2, and the display output data d2' is controlled to be smaller than the specific display data d2 in the embodiment X4) according to system requirements.

FIG. 3B illustrates four embodiments Y1-Y4, where both of the previous display data d1 and the next display data d3 are greater than the specific display data d2, and the first data change amount between the previous display data d1 and the specific display data d2 is greater than the data change threshold corresponding to the ambient temperature TEMP. In other words, the specific display data d2 cannot be displayed normally in the current ambient temperature TEMP. The embodiments Y1 and Y2 illustrate the situation where the data change amount between the specific display data d2 and the next display data d3 is smaller than the data change threshold, and the embodiments Y3 and Y4 illustrate the situation where the data change amount between the specific display data d2 and the next display data d3 is greater than the data change threshold.

In the embodiment Y1, the previous display data d1 is greater than the specific display data d2, the first data change amount is greater than the data change threshold, and the second data change amount is smaller than the data change threshold. In such a situation, the specific display data d2 cannot be displayed normally but the next display data d3 can be displayed normally. At this moment, in the premise of satisfying that a third data change amount between the display output data d2' and the next display data d3 is smaller than the data change threshold, the display output data d2' may be decreased to make the display output data d2' smaller than the specific display data d2. As can be seen from the voltage changes illustrated in FIG. 1B and FIG. 1C, the current specific display data d2 cannot be displayed accurately, i.e., the voltage of the corresponding capacitor (the source voltages B1-B4 shown in FIGS. 1B-1C) cannot achieve the predetermined voltage level. Therefore, the value of the display output data d2' may be decreased to enhance the capability of the display data (e.g., the drain voltages A1-A4 shown in FIGS. 1B-1C) pulling down the capacitor voltage. In other words, the lower display output data d2' is capable of allowing the display data, which is used for driving the liquid crystal molecules practically, to be nearer to the specific display data d2 to be displayed. Please note that the above data processing method of decreasing the value of the display output data d2' should also satisfy the premise that the third data change amount between the display output data d2' and the next display data d3 is smaller than the data change threshold, in order to prevent the value of the display output data d2' from being too low such that the next display data d3 cannot be displayed normally in the next display cycle. As described in the embodiment Y2, if the decreased value of the display output data d2' causes that the display data d3 cannot be displayed normally, the display output data d2' may remain. That is, the display output data d2' may be controlled to be equal to the specific display data d2, in order to ensure that the display data d3 can still be displayed normally.

The above embodiments illustrate the situation where the previous display data d1 is greater than the specific display data d2. On the other hand, if the previous display data d1 is smaller than the specific display data d2, the same methods of data conversion may also be applied when the first data change amount between the previous display data d1 and the specific display data d2 is greater than the data change threshold corresponding to the ambient temperature TEMP and the second data change amount between the specific display data d2 and the next display data d3 is smaller than the data change threshold. That is, when the third data change amount between the display output data d2' and the next display data d3 is smaller than the data change threshold, the display output data d2' is increased to be greater than the specific display data d2. If the increased value of the display output data d2' causes that the display data d3 cannot be displayed normally, the display output data d2' may be controlled to be equal to the specific display data d2, in order to ensure that the display data d3 can still be displayed normally.

In the embodiment Y3, both of the previous display data d1 and the next the display data d3 are greater than the specific display data d2, and both of the first data change amount and the second data change amount are greater than the data change threshold, such that both of the specific display data d2 and the next the display data d3 cannot be displayed normally. In such a situation, the display output data d2' may be increased to be greater than the specific display data d2, so that the next display data d3 can be displayed normally. In other words, the display output data d2' outputted by the processor 206 allows the third data change amount between the display output data d2' and the next display data d3 to be smaller than the data change threshold, in order to let the display data d3 to be displayed accurately. As mentioned above, the data conversion method of the present invention may maintain the accuracies of most data as far as possible, in order to allow the image displayed on the panel to possess the contrast and clarity to certain level, and prevent the image from being a blur. In the above embodiment Y3, although the accuracies of the specific display data d2 cannot be satisfied, the display output data d2' may be controlled to allow the third data change amount between the display output data d2' and the next display data d3 to be smaller than the data change threshold, in order to satisfy the accuracy of the next display data d3. Furthermore, if significant increase of the display output data d2' still cannot let the display data d3 to be displayed accurately (i.e., the situation illustrated in the embodiment Y4), selection between decreasing the display output data d2' and increasing the display output data d2' may be made. If the value of the display output data d2' is selected to be decreased to make the display output data d2' smaller than the specific display data d2, the capability of the display data pulling down the capacitor voltage may be enhanced, so that the display data practically driving the liquid crystal molecules is nearer to the specific display data d2 to be displayed. If the value of the display output data d2' is selected to be increased to make the display output data d2' greater than the specific display data d2, the accuracy of the display data d3 can still be enhanced.

FIG. 3C illustrates four embodiments Z1-Z4, where the previous display data d1 is greater than the specific display data d2, the specific display data d2 is greater than the next display data d3, and the first data change amount between the previous display data d1 and the specific display data d2 is greater than the data change threshold corresponding to the ambient temperature TEMP. In other words, the specific display data d2 cannot be displayed normally in the current ambient temperature TEMP. The embodiments Z1 and Z2 illustrate the situation where the data change amount between the specific display data d2 and the next display data d3 is smaller than the data change threshold, and the embodiments Z3 and Z4 illustrate the situation where the data change amount between the specific display data d2 and the next display data d3 is greater than the data change threshold.

In detail, the difference between the embodiment Z1 and the embodiment Y1 is that the next display data d3 is smaller than the specific display data d2 in the embodiment Z1, while the next display data d3 is greater than the specific display data d2 in the embodiment Y1. Therefore, in the embodiment Z1, the value of the display output data d2' may be decreased to enhance the capability of the display data pulling down the capacitor voltage as the data conversion method applied in the embodiment Y1. In addition, since the next display data d3 is smaller than the specific display data d2, the display output data d2' after reduction may be nearer to the next display data d3; hence, the situation where the next display data d3 cannot be displayed normally may not exist, as illustrated by the embodiment Z2.

In the embodiment Z3, the previous display data d1 is greater than the specific display data d2, the next display data d3 is smaller than the specific display data d2, and both of the first data change amount and the second data change amount are greater than the data change threshold, such that both of the specific display data d2 and the next display data d3 cannot be displayed normally. In such a situation, the display output data d2' may be decreased to make the display output data d2' smaller than the specific display data d2, so that the next display data d3 can be displayed normally. In addition, decreasing of the display output data d2' may enhance the capability of the display data pulling down the capacitor voltage, in order to enhance the accuracy of the specific display data d2. Similarly, in the embodiment Z4, although the significant decrease of the display output data d2' cannot let the next display data d3 to be displayed accurately, the accuracies of the specific display data d2 and the next display data d3 can still be enhanced by decreasing the display output data d2' to be lower than the specific display data d2.

Please note that the embodiments illustrated in FIGS. 3A-3C are only used for describing possible data conversion and processing methods under various relations of the display data value. With reference to the above principles, the practical data conversion method may record conversion methods of various display data values in the lookup tables corresponding to every temperature based on the voltage change characteristics in different ambient temperatures. In other words, those skilled in the art can design many possible lookup tables according to the above data conversion methods, and the detailed content of the lookup tables should not be limitation of the present invention.

In addition, the embodiments illustrated in FIGS. 3A-3C describe the situation where the previous display data d1 is greater than the specific display data d2. Those skilled in the art should be able to deduce the situation where the previous display data d1 is smaller than the specific display data d2 based on the above descriptions; this will not be narrated herein.

In the embodiments of the present invention, the specific display data d2 is converted according to data values of the previous display data d1 and the next display data d3 and the ambient temperature TEMP, where the data values of the previous display data d1 and the specific display data d2 are temporarily stored in the line buffer 208, and the next display data d3 except for the last row data is also temporarily stored in the line buffer 208. Since the previous display data d1 and the next display data d3 only include the display data in N row before and N row after the specific display data d2, a smaller memory such as the memory built in the LCD driving circuit is enough for implementing the line buffer 208 when the value of N is small. Since the data conversion method of the present invention does not need to consider the display data of every pixel in the previous image or the next image, a frame buffer having a larger memory such as a memory module independent of the LCD driving circuit is not required. In contrast to the method of data processing performed by considering the display data in the previous image or the next image, the present invention may save the cost of memory significantly. In addition, the present invention may display the data after delaying several data output cycles without affecting the visual experience of the user, where the delay time is determined according to the value of N. For example, the specific display data d2 may be converted into the display output data d2' in the next cycle after the line buffer 208 entirely receives the next display data d3, and then the display output data d2' may be outputted to the panel to be displayed on the panel.

After the processor 206 outputs the display output data d2', in the next data output cycle, the original display output data d2' may be regarded as a previous display data, and the original next display data d3 may be regarded as a specific display data. The line buffer 208 and the processor 206 further receive a new display data from the system, e.g., a display data d4. Subsequently, the processor 206 may perform data conversion and processing based on the above display data according to the newly received ambient temperature.

Please note that, the present invention aims at providing a data conversion method and a related display device capable of converting the display data by using data processing, in order to effectively control the display data in low temperature and prevent the image from being a blur. Those skilled in the art can make modifications and alternations accordingly. For example, the display device 20 of the present invention may be operated in any ambient temperature. When the temperature is higher enough (i.e., the display data having any change amount can always be displayed normally), the display output data d2' is always equal to the specific display data d2 in the lookup table. Alternatively, the display device 20 or the related processor 206 may be controlled to operate only when the ambient temperature is lower than a threshold value, to perform the above data conversion method. Preferably, the present invention may apply column inversion to output the display output data. In cooperation with the pre-charging method, the capacitor voltage in each pixel may achieve the predetermined voltage corresponding to the display data more accurately. More specifically, according to column inversion, the gate driving signal may undergo pre-charging in at least one data output cycle before the processor 206 outputs the corresponding display output data; hence, the source voltage of the transistor (i.e., the capacitor voltage) may reach the positive voltage or negative voltage corresponding to the polarity of the column in advance.

Figure 4:
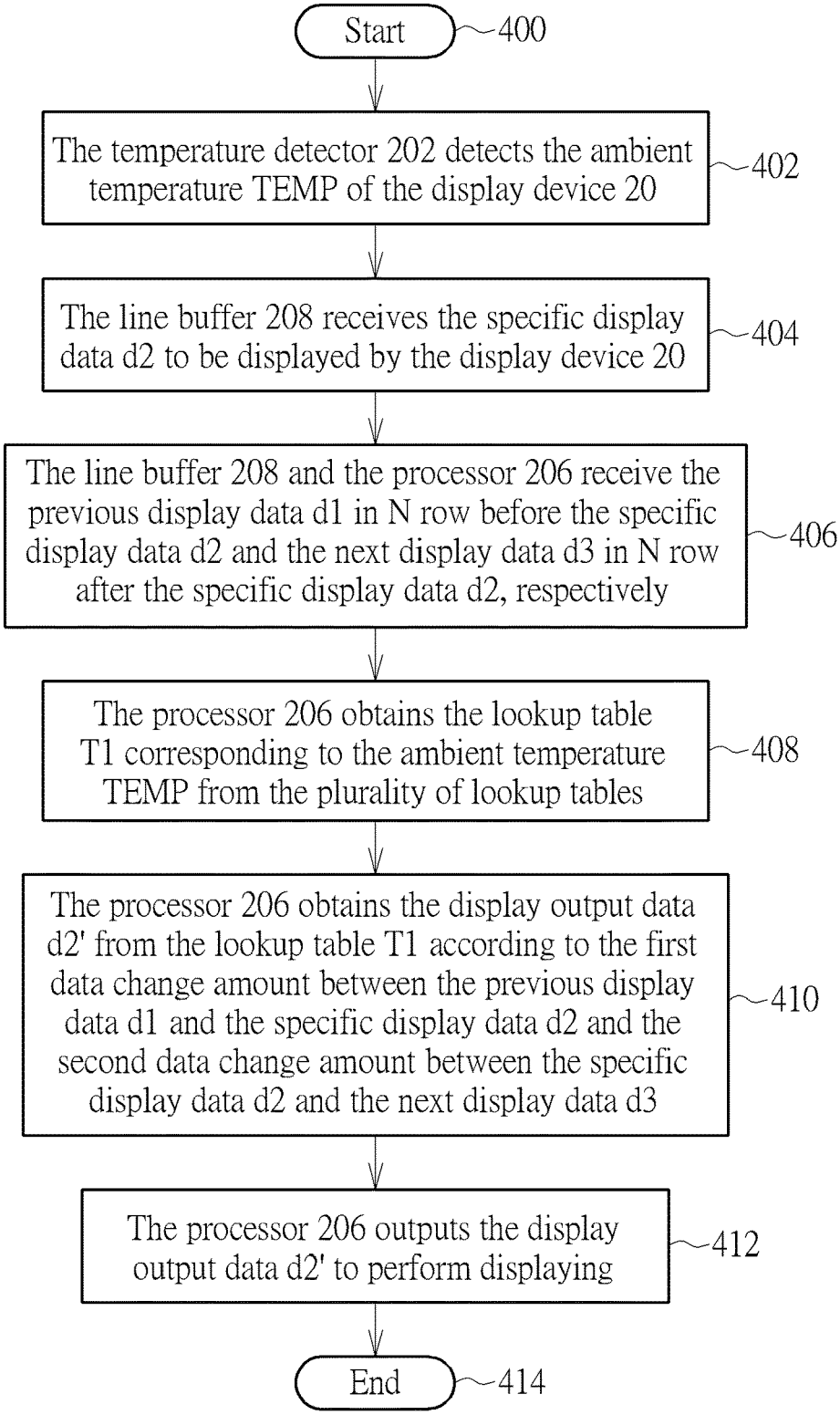
FIG. 4 is a schematic diagram of a data conversion process according to an embodiment of the present invention.

The above operations of the display device 20 performing data conversions may be summarized into a data conversion process 40, as shown in FIG. 4. The data conversion process 40 includes the following steps:

Step 400: Start.

Step 402: The temperature detector 202 detects the ambient temperature TEMP of the display device 20.

Step 404: The line buffer 208 receives the specific display data d2 to be displayed by the display device 20.

Step 406: The line buffer 208 and the processor 206 receive the previous display data d1 in N row before the specific display data d2 and the next display data d3 in N row after the specific display data d2, respectively.

Step 408: The processor 206 obtains the lookup table T1 corresponding to the ambient temperature TEMP from the plurality of lookup tables.

Step 410: The processor 206 obtains the display output data d2' from the lookup table T1 according to the first data change amount between the previous display data d1 and the specific display data d2 and the second data change amount between the specific display data d2 and the next display data d3.

Step 412: The processor 206 outputs the display output data d2' to perform displaying.

Step 414: End.

Detailed operations and alternations of the data conversion process 40 are illustrated in the above descriptions, and will not be narrated herein.

To sum up, the present invention discloses a data conversion method and a related display device capable of converting the display data by using data processing. The data conversion method may determine whether to perform adjustment or conversion on the display data according to whether the change amount of the display data exceeds the data change threshold corresponding to the ambient temperature in low temperature, in order to control the value of the display output data. With effective control of the display data, the image displayed on the panel may have contrast and clarity to certain level, and the image is prevented from being a blur.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A data conversion method for converting display data of a display device, the data conversion method comprising:

detecting an ambient temperature of the display device;

receiving a specific display data to be displayed by the display device, a previous display data in N row before the specific display data, and a next display data in N row after the specific display data;

converting the specific display data into a display output data according to the previous display data, the next display data and the ambient temperature; and outputting the display output data to perform displaying.

2. The data conversion method of claim 1, wherein N is equal to 1.

3. The data conversion method of claim 1, wherein the step of converting the specific display data into the display output data according to the previous display data, the next display data and the ambient temperature comprises:

obtaining a lookup table corresponding to the ambient temperature; and obtaining the display output data from the lookup table according to a first data change amount between the previous display data and the specific display data and a second data change amount between the specific display data and the next display data.

4. The data conversion method of claim 3, wherein the display output data is same as the specific display data when the first data change amount and the second data change amount are smaller than a data change threshold corresponding to the ambient temperature.

5. The data conversion method of claim 1, wherein the specific display data is converted into the display output data so that at least one of an accuracy of the specific display data and an accuracy of the next display data is satisfied when the accuracies of the specific display data and the next display data are not satisfied simultaneously.

6. The data conversion method of claim 1, wherein the data conversion method is performed when the ambient temperature is lower than a threshold value.

7. The data conversion method of claim 1, wherein the display output data is outputted with column inversion.

8. The data conversion method of claim 1, wherein a gate driving signal of the display device undergoes a pre-charging in at least one data output cycle before the display device outputs the display output data corresponding to the gate driving signal.

9. A display device for performing a data conversion method, the display device comprising:

a temperature detector, for detecting an ambient temperature of the display device;

a storage device, for storing a plurality of lookup tables;

a line buffer, for receiving and storing a specific display data to be displayed by the display device and a previous display data in N row before the specific display data; and a processor, for receiving a next display data in N row after the specific display data and performing the following steps:

obtaining a lookup table corresponding to the ambient temperature from the plurality of lookup tables;

obtaining a display output data from the lookup table according to a first data change amount between the previous display data and the specific display data and a second data change amount between the specific display data and the next display data; and outputting the display output data to perform displaying.

* * * * *